United States Patent [19]

Dikoff

[11] Patent Number: 4,856,212

[45] Date of Patent: Aug. 15, 1989

[54] CORDLESS IRON WITH HIGH-TEMPERATURE, NON-SCORCHING SOLE PLATE SURFACE

[76] Inventor: Joseph Dikoff, 1510 Andalusia Ave., Venice, Calif. 90291

[21] Appl. No.: 229,712

[22] Filed: Aug. 8, 1988

[51] Int. Cl.[4] ..... D06F 75/18; D06F 75/26; D06F 75/38; D06F 75/40

[52] U.S. Cl. ..... 38/93; 38/77.83; 38/82; 219/247; 428/458

[58] Field of Search ..... 219/247; 38/82, 93, 38/77.83; 428/458, 141, 422, 423.5

[56] References Cited

U.S. PATENT DOCUMENTS

| | | | |
|---|---|---|---|
| 3,435,548 | 4/1969 | Dikoff | 38/97 |
| 3,941,911 | 3/1976 | Newton | 428/423.5 |
| 4,143,209 | 3/1979 | Fang | 428/422 X |
| 4,352,847 | 10/1982 | Okiyama | 427/141 |
| 4,415,796 | 11/1983 | Balchunas | 38/82 X |
| 4,448,844 | 5/1984 | Osada et al. | 428/458 X |
| 4,543,295 | 9/1985 | St. Clair et al. | 428/458 |
| 4,688,339 | 8/1987 | Tsai | 219/247 X |
| 4,719,334 | 1/1988 | Rebel | 219/247 |
| 4,774,395 | 9/1988 | Yabuuchi et al. | 38/77.83 X |

*Primary Examiner*—Andrew M. Falik
*Attorney, Agent, or Firm*—Bruce L. Birchard

[57] ABSTRACT

Cordless-iron apparatus in which the sole plate of the cordless iron is covered with a polyimide film synthesized by a polycondensation reaction between an aromatic tetrabasic acid and an aromatic amine. Such a film exhibits a broad range of temperature stabililty, thus permitting the heating of the sole plate to relatively high temperatures without wrinkling of the film and without causing scorching of the fabric to be ironed. Steam pressing without spotting is achieved by metering the water flowing to the heated recess in the non-exposed region of the sole plate, which sole plate has apertures for the passage of steam therethrough, the polyimide cover for the sole plate also being apertured.

8 Claims, 2 Drawing Sheets

CORDLESS IRON WITH HIGH-TEMPERATURE, NON-SCORCHING SOLE PLATE SURFACE

BACKGROUND OF THE INVENTION

1. Field of the Invention.

This invention relates to cordless-iron apparatus and, more specifically, to such apparatus which permits effective use of the iron, itself, on any kind of fabric without damage to the fabric.

2. Prior Art.

Cordless irons and the bases therefor, together referred to herein as "cordless-iron apparatus", exist in various forms, all primarily including an iron having an electrically heated, heat-retention sole plate, the heating occurring while the iron, itself, is secured in its base, which base includes an electrical connector designed and positioned to co-operate with a corresponding connector carried on the heel of the iron. *Consumer Reports* in its March, 1987 issue reports that its biggest objection to cordless irons is the need to frequently replace the iron in its base. They also cite the need to set the temperature of the iron for a particular fabric in order to avoid melting the fabric being ironed.

In my earlier U.S. Pat. Nos. 3,269,040 and 3,435,548 I attempted to solve this and other problems. However, I have found that the structure recited therein is unduly expensive and that the sole-plate-covering materials described therein tend to deform and sag, making ironing more difficult and the results of the ironing less satisfactory. Specifically, in my U.S. Pat. No. 3,435,548 at column 5, lines 43–51 I refer to the use of a sheet of aromatic polyamide laminated over the shoe. However, my experience has shown that such polyamides do not have the dimensional stability of the polyimide film used in this invention.

Further, cordless irons are usually equipped with a steam generating mechanism which may cause wetting instead of steaming of the material being ironed as a result of an uncontrolled amount of water being injected into the steam-generating chamber.

Therefore, it is an object of this invention to overcome the various problems described for prior art cordless-iron apparatus.

It is a further object of this invention to provide cordless-iron apparatus including a cordless iron which may be heated to a high temperature and used without scorching the material being ironed.

It is a further object of this invention to provide a cordless iron with effective and controlled steam generation.

SUMMARY OF THE INVENTION

By providing over the sole plate of a cordless iron a polyimide film synthesized by a polycondensation reaction between an aromatic tetrabasic acid and an aromatic amine (available from Du Pont Industrial Films Division as "KAPTON") the iron may be heated to nearly 400 degrees C. without warping or melting the film, thus permitting infrequent re-heating of the iron while assuring ironing without scorching or melting the fabric being ironed.

The steaming of the fabric being ironed without merely wetting the fabric is achieved by metering the amount of water passing into the steam chamber, whereby all of the water entering the chamber is converted to steam.

BRIEF DESCRIPTION OF THE DRAWINGS

The features of the present invention which are believed to be novel are set forth with particularity in the appended claims. The present invention, both as to its organization and manner of operation, together with further objects and advantages thereof, may be best understood by reference to the following description taken in conjunction with the accompanying drawings, in which:

DETAILED DESCRIPTION OF THE PREFERRED EMBODIMENT

Figure 1:
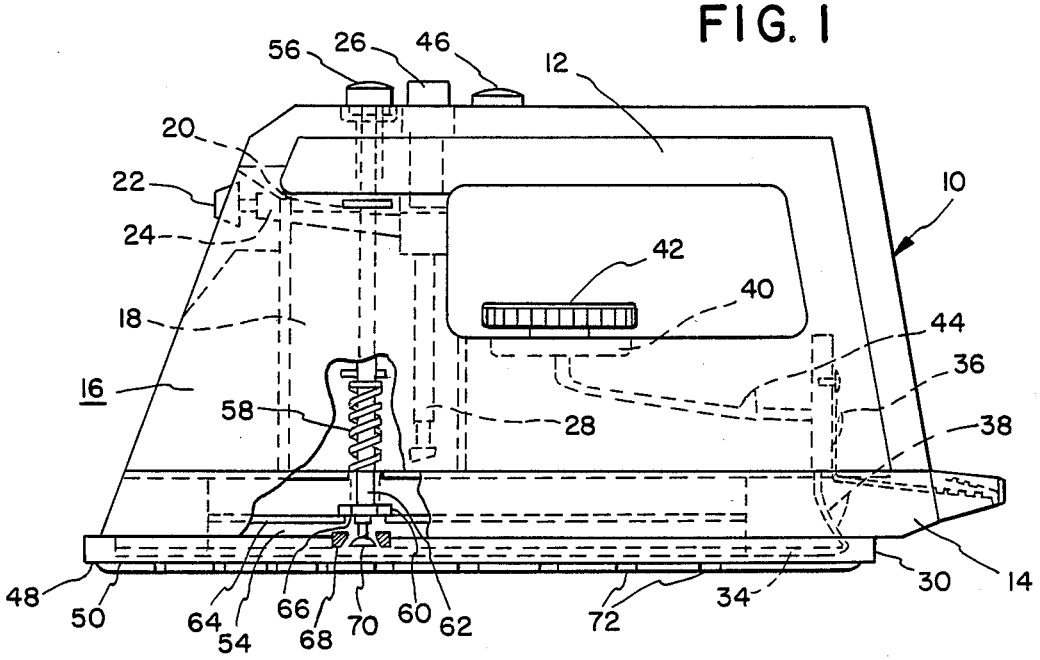
FIG. 1 is a side elevational view, partially cut away, showing an iron according to the present invention.

In FIG. 1, iron 10 includes handle portion 12 which is attached to or integrally formed with foot portion 14 and body portion 16. Body portion 16 includes main water reservoir 18 having a filling opening 20, not shown, on the reverse side of body 16.

Spray outlet 22 is connected to main reservoir 18 by way of tube 24 through which water is pumped from reservoir 18 by the activation of spray pump button 26, which is connected to pump mechanism 28. The details of this kind of pump mechanism are well known and need not be described here.

Figure 3:
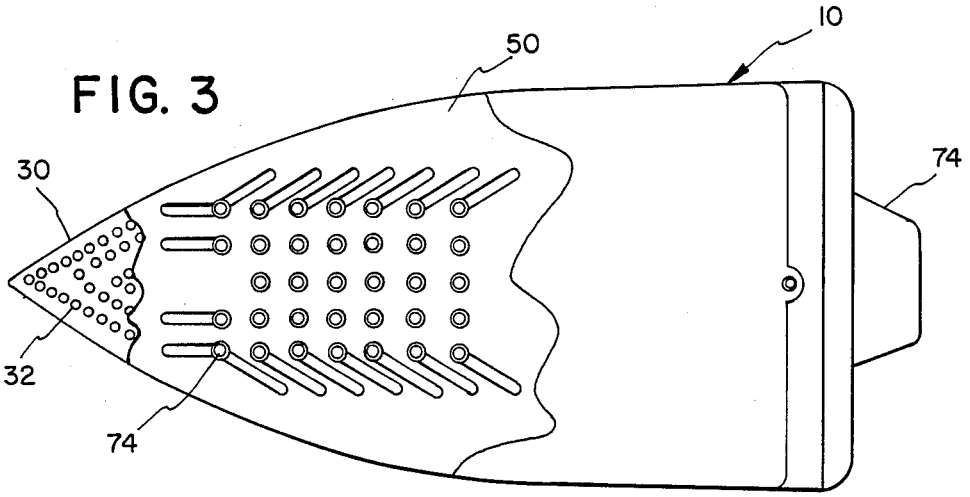
FIG. 3 is a bottom view, partially cut away, of the iron of FIG. 1.

Foot portion 14 has attached thereto sole plate 30 which is made of die cast aluminum, for example, and contains openings 32 therein which can be seen more clearly in FIG. 3. Such openings are provided to permit the escape of steam from the iron.

An electrically-insulated heating element 34 is carried in sole plate 30. It is connected to electrical terminal block 36 by means of connectors 38. Current to heater 34 is controlled by rheostat 40 operated by turning knob 42. Rheostat 40 is connected to terminal block 36 by means of connectors 44 Knob 42 contains thereon indicia from which the user can set the rheostat at the right resistance level (i.e. the right temperature level for sole plate 30) for any given fabric to be ironed. If the temperature of the sole plate 3 falls below the desired temperature light 46 is illuminated. Sole plate 30 is covered, on its lower surface 48, with a layer 50 of a polyimide film synthesized by a polycondensation reaction between an aromatic tetrabasic and an aromatic amine. It has dimensional stability from −269 degrees C. to 400 degrees C. It also has good heat conductivity and a low coefficient of friction. It is sold by the Du Pont Industrial Films Division of Wilmington, Del. under the name of "KAPTON"-Type H. Thus, this layer 50 does not wrinkle at ironing temperatures. At the same time, the material being ironed does not scorch, an ideal combination.

Layer 50 has apertures 52 therein for the passage of steam therethrough.

That steam is generated when a predetermined amount of water from secondary reservoir 54 is permitted to fall onto sole plate 30 in the region being heated by heating element 34. To produce the metered amount of steam, button 56 is depressed against the resistance of spring 58 until gasket 60, carried in a fixed position on shaft 62, which shaft also carries button 56, engages upper wall 64 of secondary reservoir 54, which has an opening 66 therein. At the same time, the depression of steam button 56 causes the poppet valve comprising seat 68 and poppet 70 to open, discharging the volume of water in secondary reservoir 54, and only that volume, onto heating element 34 and heated sole plate 30, producing the quantity of steam desired. It should be noted that water from the main reservoir 18 cannot, by reason of the closing of opening 66 by gasket 60, enter secondary reservoir 54 until button 56 is released, at which time the poppet valve comprising seat 68 and poppet 70 is closed. This control, or metering, of the water converted to steam is important because, in prior art devices, it did not exist and, if the operator pressed the "steam" button too long water, not steam, went onto the fabric and spotted it. Of course, the steam generated passes out of apertures 32 in sole plate 30 and through apertures 72 in sole plate covering layer 50, to the material being ironed.

Figure 2:
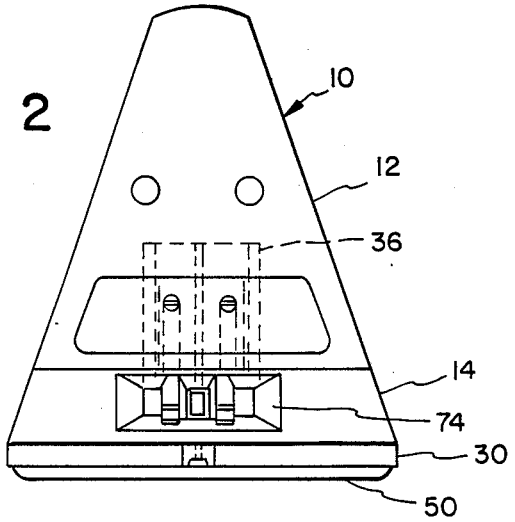
FIG. 2 is an end elevational view of the iron of FIG. 1.

In FIG. 2, foot 14 of iron 10 carries connector 74 which has its contact elements enclosed to prevent sparking. Connector 74 is of the female type being adapted to cooperate with male connectors on base member 80 shown in FIGS. 4 thru 6.

In FIG. 3, iron 10 has sole plate 30 with apertures 32 therein and scorch-preventing layer 50 with apertures 72 therein.

Figure 4:
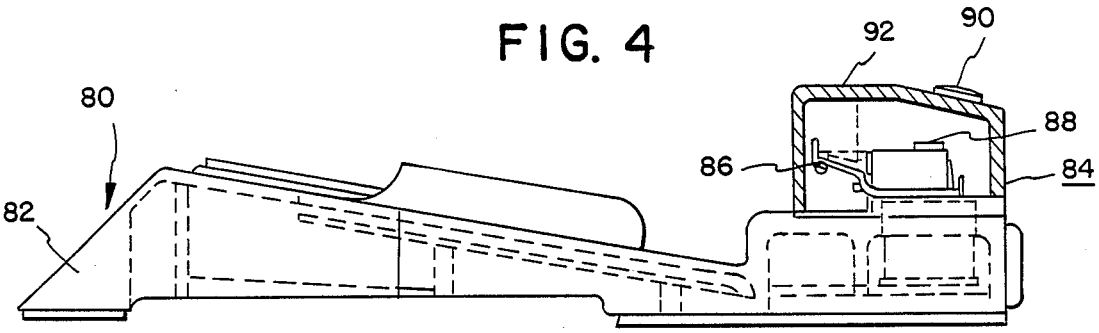
FIG. 4 is a side elevational view of a base for the iron of FIG. 1.
Figure 5:
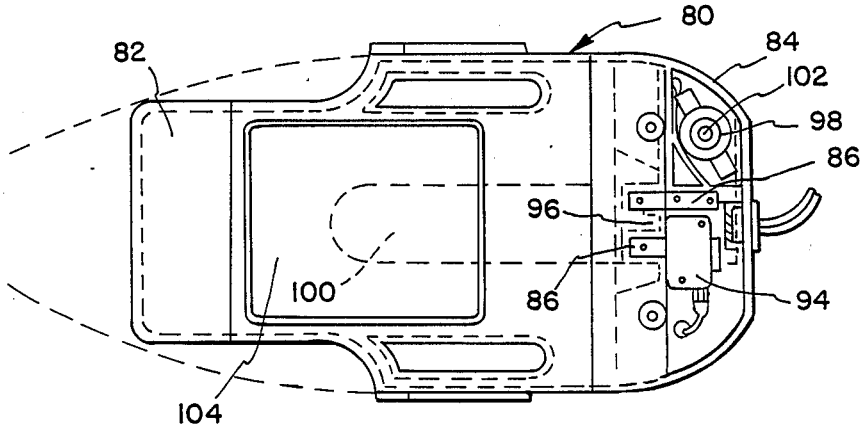
FIG. 5 is a top view of the base of FIG. 4.
Figure 6:
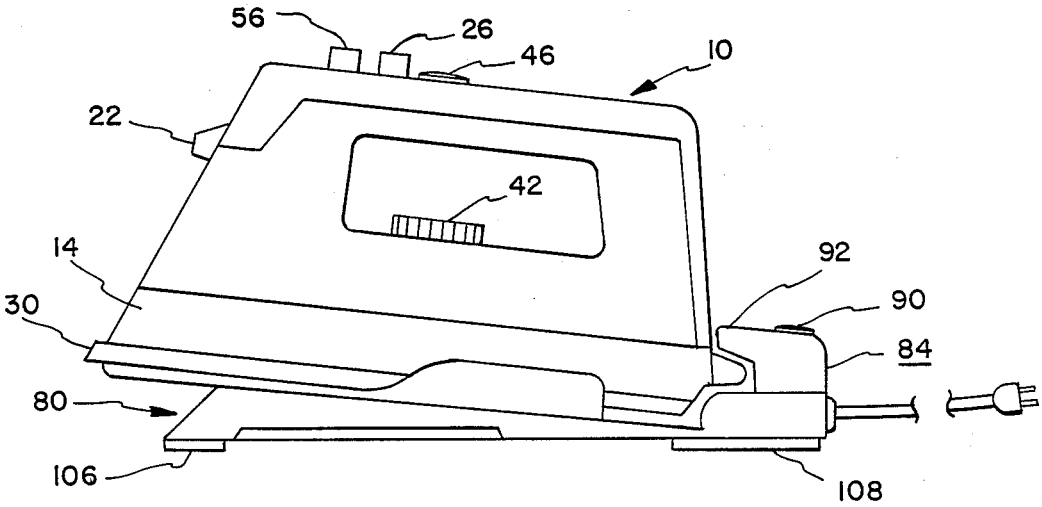
FIG. 6 is an assembly view showing the cordless-iron apparatus, according to the present invention in its base of FIG. 4.

Turning to FIGS. 4, 5 and 6, base 80 has platform portion 82 terminating in connector portion 84. Connector portion 84 has male connector 86, adapted to receive female connector 74 on iron 10. A light 88 is lighted when iron 10 is drawing current. Light 88 is viewed through window 90 in housing 92 which surrounds connector 86 and assures safety for the operator.

Micro switch 94 is only closed (by pressure from iron 10 on actuator button 96) when the iron 10 is placed in base 80 with connectors 74 and 86 engaged.

Base 80 includes a thermal cut-out switch 98 which receives heat from metal plate 100 in platform 82 and, after approximately 45 minutes of the iron sitting, unmoved, on platform 82, the electrical current flowing to iron 10 is cut-off by switch 98. This alleviates the fear that the iron may be forgotten and, consequently cause a fire. To re-set thermal cut-out switch 98, button 102 must be pushed.

A layer 104 of KAPTON, or the like, may be carried on the upper surface of platform 82 to prevent abrasion of layer 50 on iron 10. Rubber feet 106, 108 may be provided to preventing skidding of base 80 when iron 10 is placed on platform 82.

While particular embodiments of this invention have been shown and described it will be apparent to those skilled in the art that alterations or modifications of such embodiments may be made without departing from the spirit and scope of this invention. It is the purpose of the appended claims to cover all such alterations and modifications.

I claim:

1. A cordless iron, including:

a handle portion;

a body portion connected to said handle portion;

a foot portion connected to said body portion and, a sole plate connected to said foot portion;

said sole plate carrying, on the exposed surface thereof, a layer of polyimide film;

said body portion of said cordless iron including a main reservoir portion and said foot portion including a secondary reservoir portion selectively hydraulically couplable to said main reservoir portion;

said sole plate having a recess in its non-exposed surface for receiving a heating element;

an axially movable valve-operating shaft carried in said handle portion and in said body portion;

said secondary reservoir portion having an upper wall and a lower wall, said upper wall having an opening therein through which said valve-operating shaft passes centrally;

said valve-operating shaft terminating, at its end proximate to said handle, in an opeating button and, at its other end, in the poppet portion of a poppet valve;

said shaft carrying in a fixed position thereon on the side of said upper wall facing said main reservoir, a gasket-like valve member having a diameter exceeding that of said opening, said gasket-like valve member being movable with said shaft into a position to close off said opening;

a seat member for said poppet valve, said seat member being carried by said lower wall in coaxial alignment with said opening in said upper wall, said poppet being spaced from said gasket-like member a distance such that said poppet member moves away from said seat when said gasket-like valve member closes said opening in said upper wall of said secondary reservoir, whereby the contents of said secondary reservoir, only, are discharged into said recess in said non-exposed surface of said sole plate.

2. Apparatus according to claim 1 which includes, in addition, a base for receiving said cordless iron, said cordless iron having a first electrical connector thereon, said base having a complementary electrical connector positioned thereon for receiving said first electrical connector; said base including, in addition, thermally actuated means for breaking the flow of electrical current to said cordless iron when the temperature of the sole plate thereof exceeds a predetermined level.

3. Apparatus according to claim 2 which includes, in addition, apparatus carried by said base for indicating the flow of electrical current to said cordless iron.

4. Apparatus according to claim 2 in which said base includes a platform portion for receiving said cordless iron, said platform portion for receiving said cordless iron, said platform portion carrying a thermally conductive plate thereon, said thermally conductive plate being thermally coupled to said thermally actuated means.

5. Apparatus according to claim 4 which includes, in addition, a polyimide cover for said thermally conductive plate.

6. Apparatus according to claim 1 in which said valve-operating shaft is spring biased towards said handle portion.

7. Apparatus according to claim 1 which includes, in addition, spray means hydraulically coupled to said main reservoir by way of a manual pump.

8. Apparatus according to claim 1 which includes, in addition, an apertured sole plate and an apertured sole plate cover.

* * * * *